US009948044B2

(12) United States Patent
Harris, III et al.

(10) Patent No.: US 9,948,044 B2
(45) Date of Patent: Apr. 17, 2018

(54) ELECTRICAL AND MECHANICAL CONNECTOR

(71) Applicant: Faraday & Future Inc., Gardena, CA (US)

(72) Inventors: John Henry Harris, III, San Gabriel, CA (US); Kameron Fraige Saad Buckhout, Inglewood, CA (US)

(73) Assignee: FARADAY & FUTURE INC., Gardena, CA (US)

( * ) Notice: Subject to any disclaimer, the term of this patent is extended or adjusted under 35 U.S.C. 154(b) by 0 days.

(21) Appl. No.: 15/262,656

(22) Filed: Sep. 12, 2016

(65) Prior Publication Data

US 2018/0076585 A1 Mar. 15, 2018

(51) Int. Cl.
*H01R 4/48* (2006.01)
*H01R 25/16* (2006.01)

(52) U.S. Cl.
CPC ..... *H01R 25/162* (2013.01); *H01R 4/48* (2013.01)

(58) Field of Classification Search
CPC ..... H01R 13/2421; H01R 4/4863; H01R 13/111; H01R 13/17; H01R 13/15; H01M 2/26; H01M 2/30
See application file for complete search history.

(56) References Cited

U.S. PATENT DOCUMENTS 4,042,759 A * 8/1977 Cella ..... H01M 2/305 429/121
4,810,213 A * 3/1989 Chabot ..... H02B 11/04 439/825
8,114,540 B2 * 2/2012 Trester ..... H01M 2/202 174/68.2
9,293,849 B2 * 3/2016 Balsells ..... H01R 13/03

* cited by examiner

*Primary Examiner* — Xuong Chung Trans
(74) *Attorney, Agent, or Firm* — Knobbe, Martens, Olson & Bear LLP

(57) ABSTRACT

Systems and methods for electrical connections between electrical components or flow paths are described. Systems can include a pin having a proximal end and a distal end, a proximal groove disposed between and spaced vertically from the proximal end and the distal end, and a distal groove disposed between and spaced vertically from the proximal groove and the distal end. A proximal garter spring can be disposed around the pin at least partially within the proximal groove, and a distal garter spring can be disposed around the pin at least partially within the distal groove. The proximal garter spring and distal garter spring can be configured to compress in order to mechanically and electrically couple a first electrical flow path and a second electrical flow path.

20 Claims, 3 Drawing Sheets

ELECTRICAL AND MECHANICAL CONNECTOR

BACKGROUND

Field

The present disclosure is related to current carrying connections. More particularly, a bus bar and mating pin assembly configured for quick connection are described herein.

Description of the Related Art

Bus bars (or busbars) are metallic strips that conduct electricity. Bus bars are generally used to carry substantial electric currents over relatively short distances. Electrical connections to bur bars are typically welded, soldered, clamped, or bolted to the bus bar.

SUMMARY

The devices, systems, and methods disclosed herein have several features, no single one of which is solely responsible for its desirable attributes. Without limiting the scope as expressed by the claims that follow, its more prominent features will now be discussed briefly. After considering this discussion, and particularly after reading the section entitled "Detailed Description of the Preferred Embodiments" one will understand how the features of the system and methods provide several advantages over traditional systems and methods.

In one embodiment, a current carrying connection assembly between a first and second current flow path is described. The connection assembly includes a pin having at least one circumferential groove disposed therein, the groove forming at least a portion of a first electrical path through the pin, at least one electrically conductive spring disposed within the circumferential groove, a coupling having at least a portion of a second electrical path through the coupling, and a receiving space within the coupling, the receiving space sized and shaped to receive at least a portion of the pin, wherein the spring compresses upon insertion of the pin into the receiving space and forms an electrical connection between the first and second flow path and a mechanical connection between the pin and the coupling. The pin may include a terminal post of a battery. The pin may further include a second circumferential groove disposed therein and a second spring disposed within the second circumferential groove. The coupling may include at least a portion of a bus bar.

In another embodiment, an assembly for electrically connecting a bus bar to one or more electrical components is described. The assembly includes a pin having a proximal end and a distal end, a proximal groove disposed between and spaced vertically from the proximal end and the distal end, and a distal groove disposed between and spaced vertically from the proximal groove and the distal end. The proximal groove includes a section of the pin having a smaller cross-sectional area than the adjacent sections of the pin proximal and distal to the proximal groove. The distal groove includes a section of the pin having a smaller cross-sectional area than the adjacent sections of the pin proximal and distal to the distal groove. The assembly further includes a proximal garter spring disposed around the pin at least partially within the proximal groove and a distal garter spring disposed around the pin at least partially within the distal groove. The proximal garter spring and distal garter spring are configured to compress in order to mechanically and electrically couple the pin to a bus bar when the pin is inserted into an opening in the bus bar.

The assembly may further include a support flange disposed between the proximal end and the proximal groove, the support flange spaced vertically from the proximal groove and comprising a section of the mating pin having a larger cross-sectional area than the adjacent section of the mating pin distal to the support flange. The support flange may include a distal surface configured to abut a proximal surface of the bus bar coupled to the pin. The pin may include a metal alloy. The metal alloy may include aluminum. The proximal garter spring and the distal garter spring may include a metal alloy. The metal alloy may include copper. The proximal garter spring and the distal garter spring may include slanted coil springs.

In another embodiment, an electrical connection device is described. The device includes a mating assembly, including an electrically conductive extension extending along a vertical axis, a proximal garter spring disposed radially about the extension, and a distal garter spring disposed radially about the vertical axis at a location between and spaced vertically from the proximal garter spring and the distal end of the extension. The proximal end is secured to a surface normal to the vertical axis. The device further includes an electrically conductive bus bar comprising an aperture extending therethrough, the aperture configured to receive the extension, the aperture having a diameter smaller than an outer diameter of the proximal garter spring and an outside diameter of the distal garter spring. The proximal garter spring and the distal garter spring are at least partially compressed by an interior surface of the aperture, and wherein the distal spring is configured to exert against the bus bar a force having a vertical component in the proximal direction.

The aperture may include a proximal end on a proximal surface of the bus bar and a distal end on a distal surface of the bus bar. The distal end of the aperture may be circular and include a chamfer configured to contact the distal garter spring. The distal garter spring may be configured to prevent vertical movement of the bus bar with respect to the extension. The proximal garter spring and the distal garter spring may be configured to electrically connect the extension and the bus bar. The surface normal to the vertical axis may be a portion of a housing, the housing containing one or more electrochemical cells connected electrically to the extension. The bus bar may be electrically connected to one or more electrically powered systems configured to draw electric current from the one or more electrochemical cells through the electrical connection.

BRIEF DESCRIPTION OF THE DRAWINGS

The following is a brief description of each of the drawings. From figure to figure, the same reference numerals have been used to designate the same components of an illustrated embodiment. The drawings disclose illustrative embodiments and particularly illustrative implementations in the context of connecting a plurality of electrochemical cells. They do not set forth all embodiments. Other embodiments may be used in addition to or instead. Conversely, some embodiments may be practiced without all of the details that are disclosed. It is to be noted that the Figures may not be drawn to any particular proportion or scale.

DETAILED DESCRIPTION OF THE PREFERRED EMBODIMENTS

Figure 1:
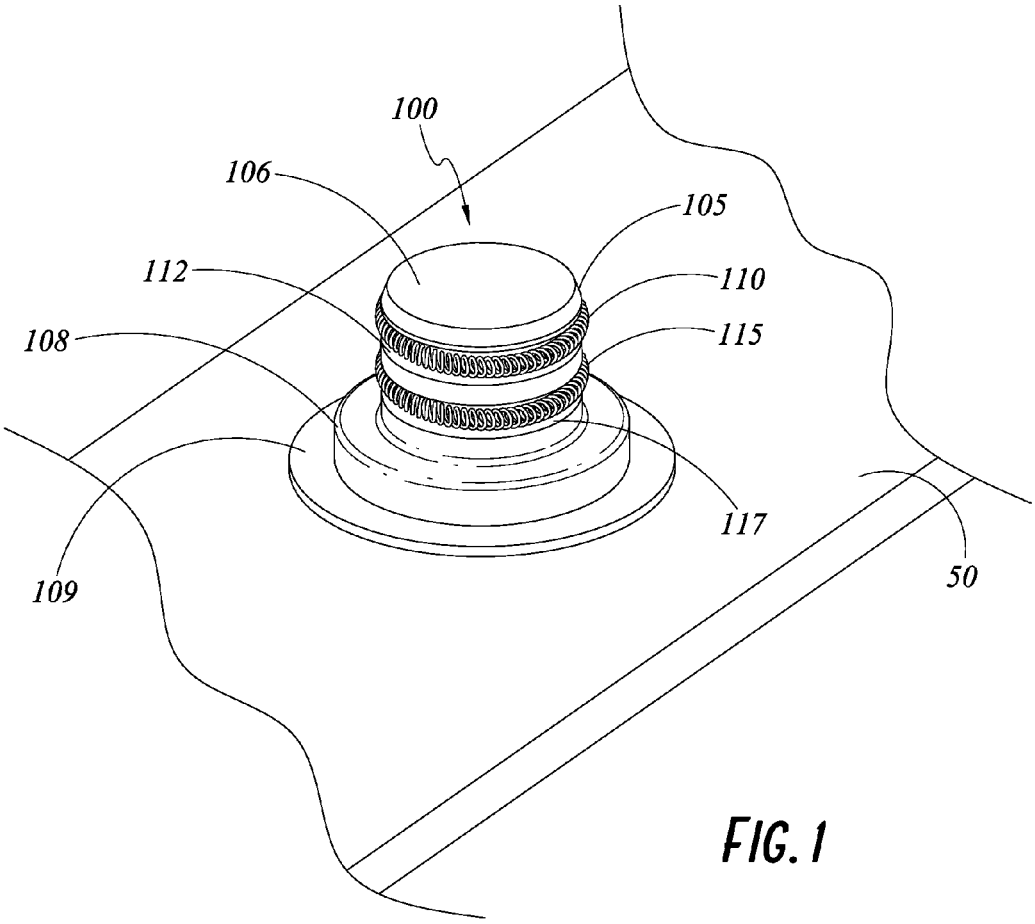
FIG. 1 is a perspective view of a bus bar mating connector in accordance with an exemplary embodiment.

Various electrical applications, such as batteries, use bus bars to conduct electricity. For example, an automotive battery may include one or more bus bars to electrically couple one or more battery cells within a housing to positive and negative terminal posts that pass through the housing. One or more bus bars may also be used to connect a plurality of battery modules within a larger battery pack. Advantages of conducting electrical current through bus bars include efficient transfer of electricity, enhanced current capacity, reduced energy loss, and increased structural integrity relative to flexible wiring.

Connections between a bus bar and other electrical components can be difficult due to the relatively inflexible composition of the bus bar. Bus bars are frequently attached to other current carrying structures by bolting, welding, or the like, which can be time-consuming and/or difficult, requiring a high level of skill for assembly. In addition, a bus bar attached by bolting or welding may be incorrectly positioned without being detected. Incorrect positioning and/or a narrow or weak connection between a bus bar and adjacent electrical components may partially or entirely negate the desirable current carrying attributes of the bus bar. Bolt-in connections are not easily connected and disconnected. In addition, bolt-in connections require a torquing force that may damage or fray wiring and/or twist and/or deform delicate circuitry.

The following description is directed to certain implementations for the purpose of describing the innovative aspects of this disclosure. However, a person having ordinary skill in the art will readily recognize that the teachings herein can be applied in a multitude of different ways.

As used herein, the term "electric vehicle" can refer to any vehicle that is partly or entirely operated based on stored electric power, such as a pure electric vehicle, plug-in hybrid electric vehicle, or the like. Such vehicles can include, for example, road vehicles (cars, trucks, motorcycles, buses, etc.), rail vehicles, wheeled robots, or the like.

In some implementations, the word "battery" or "batteries" will be used to describe certain elements of the embodiments described herein. It is noted that "battery" does not necessarily refer to only a single battery cell. Rather, any element described as a "battery" or illustrated in the Figures as a single battery in a circuit may equally be made up of any larger number of individual battery cells and/or other elements without departing from the spirit or scope of the disclosed systems and methods.

Reference may be made throughout the specification to a "12 volt" power systems or sources. It will be readily apparent to a person having ordinary skill in the art that the phrase "12 volt" in the context of automotive electrical systems is an approximate value referring to nominal 12 volt power systems. The actual voltage of a "12 volt" system in a vehicle may fluctuate as low as roughly 4-5 volts and as high as 16-17 volts depending on engine conditions and power usage by various vehicle systems. Such a power system may also be referred to as "low voltage" battery systems. Some vehicles may use two or more 12 volt batteries to provide higher voltages. Thus, it will be clear that the systems and methods described herein may be utilized with low voltage battery arrangements in at least the range of 4-34 volts without departing from the spirit or scope of the systems and methods disclosed herein.

To assist in the description of various components of the systems described herein, the following coordinate terms are used. A "vertical axis" is an axis normal to a surface to which a mating pin is secured. The terms "proximal" and "distal" refer to relative locations along the vertical axis, and are used relative to the surface. For example, the mating pin 105 in FIG. 1 extends distally from the surface along the vertical axis. Surface 106 of the mating pin 105 is located at the distal end of the mating pin 105, while the attachment plate 109 is located at the proximal end of the mating pin 105. A "transverse" plane is a plane normal to a vertical axis. For example, the distal surface 106 depicted in FIG. 1 lies within a transverse plane.

The present disclosure may be implemented to achieve one or more advantages over traditional systems and methods for securing bus bars to electrical components. In some aspects, assembly is simplified. For example, by utilizing the disclosed mating pin assembly, a bus bar may be secured to another electrical component by a snap fit, eliminating the time and skill required to weld, bolt, or otherwise secure the components together. Moreover, the use of such a connector allows bus bars to be more easily removed and re-attached to electrical connections than welding, bolting, and the like. The disclosed connectors also do not require a torquing force for coupling of an electrical connection to the bus bar. Thus, the risk of damaging or deforming the electrical connection is reduced or eliminated.

In certain aspects, quality control of assembly may also be enhanced. For example, the mating pin assembly disclosed can provide tactile and audio feedback to a person connecting a bus bar to the mating pin assembly. The tactile and audio feedback confirms that the bus bar is firmly secured to the mating pin assembly, while a lack of such feedback can indicate that the connection was not successful and permit the assembler to address the problem.

In other aspects, the mating pin assembly disclosed herein may provide more robust electrical connections between a bus bar and other components. For example, the shape of the mating pin, in combination with the position and operation of collapsible springs disposed around the mating pin in the assembly disclosed herein, can provide a relatively large conductive surface area between the bus bar and the mating pin. The springs also make the connection more robust against vibration, motion or other disruptive forces. The designs disclosed herein may further provide a lower-profile connection allowing for more compact electrical components.

The pin and spring combination may provide a means for electrically and mechanically securing one part of an electrical path to another. When the pin and spring are inserted into a receiving space, the spring is compressed, thus providing an outward force that helps mechanically secure the pin within the receiving space such that movement of the pin relative to the receiving space is inhibited. The compression of the spring also forms an electrical connection between the spring and at least a portion of the receiving space.

In some aspects, the pin and spring combination is provided on the positive and/or negative terminal(s) of a battery (e.g. an automotive battery). While the pin and spring combination is described herein as being received by a bus bar, other electrical connections are possible. For example, the pin and spring combination may be received by an opening within another battery or an opening within a cylindrical coupling. FIG. 1 is a perspective view showing a bus bar connector that includes a mating pin assembly 100 installed on a surface 50. The mating pin assembly 100 includes a mating pin 105 having a distal surface 106, a support flange 108, and an attachment plate 109. The mating pin 105 further includes a distal groove 112 configured to receive and partially enclose a distal spring 110 and a proximal groove 117 configured to receive and partially enclose a proximal spring 115. As will be described in greater detail below, the support flange 108 is configured to support and abut the proximal side of a bus bar when the bus bar is connected to the mating pin assembly 100. While a flange 108 and an attachment plate 109 are shown in FIG. 1, such parts are not required. Thus, in some embodiments, the pin 105 simply extends upward from a flat surface.

While two springs are shown and described, only one spring is necessary. More than two springs may also be included. For example, some embodiments include only a proximal groove 117 and a proximal spring 115 or only a distal groove 112 and a distal spring 110. In other embodiments, the pin 105 includes a single groove positioned at about middle of the pin and a single spring inserted therein. In other embodiments, the pin 105 may include three, four, five, ten, or more springs. Individual, vertically separated grooves may be provided for each of the springs. In other implementations, a single groove is used to house more than one spring. For example, two or three of more springs may be positioned in a single groove. A longer length pin 105 may be used to accommodate a larger number of springs and grooves while maintaining appropriate vertical spacing between the springs. Manufacturing costs, material costs, and/or available space due to nearby parts may be limiting factors in selecting the length of the pin 105 and number of springs.

The distal spring 110 and proximal spring 115 may be configured to collapse and/or compress to accommodate and maintain an electrical connection with a bus bar. For example, the distal spring 110 and proximal spring 115 may be garter springs or the like, and may include coils that are slanted, canted, biased, or otherwise angled or inclined relative to a radius of the mating pin (e.g., a line extending radially outward normal to the vertical axis). Such springs are commercially available from, for example, Bal Seal® Engineering, Inc.

The surface 50 can be a surface of any structure containing electrical components. For example, the surface 50 can be a portion of the surface of a battery module housing. The battery module can include one or more electrochemical cells. The mating pin 105 may be electrically coupled to any electrical components below surface 50 by internal electrical connections (not shown). In some aspects, the mating pin assembly 100 may be a positive or negative terminal post of a battery, battery module, or battery subcomponent. All of, or a portion of, the mating pin may be electrically conductive.

Figure 2A:
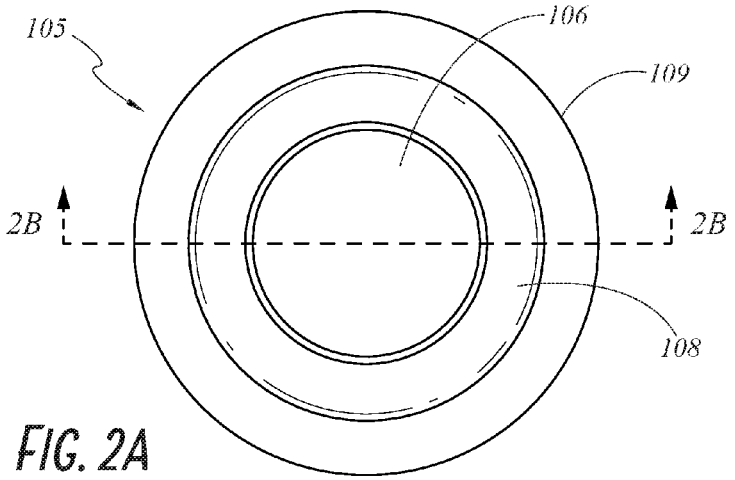
FIG. 2A is a top view of the bus bar mating pin of FIG. 1.
Figure 2B:
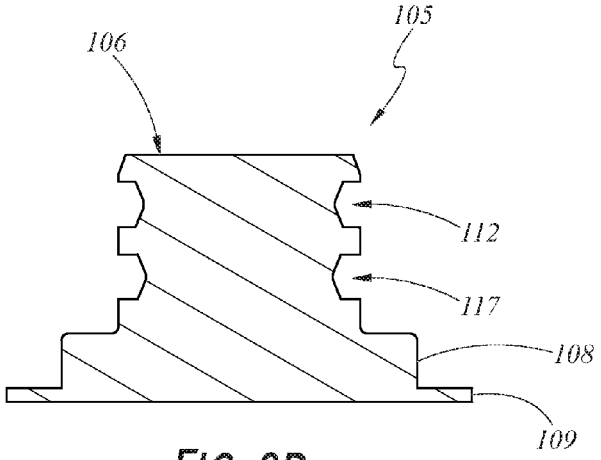
FIG. 2B is a cross-sectional view of the bus bar mating pin of FIG. 2A taken about the line 2B-2B in FIG. 2A.

FIGS. 2A and 2B depict a mating pin 105 consistent with the mating pin 105 depicted in FIG. 1. FIG. 2A is a top view of the mating pin 105. FIG. 2B is a cross-sectional view of the mating pin 105 taken about the line 2B-2B in FIG. 2A. As described above with reference to FIG. 1, the mating pin 105 includes a distal surface 106, a support flange 108, an attachment plate 109, distal groove 112, and proximal groove 117. In some embodiments, the components of the mating pin 105 may be formed as a single piece of material, such as by machining (e.g., by a milling machine or lathe), casting, or the like. The mating pin 105 or portions thereof can be made of any suitable conductive material, which can be a metal such as aluminum, copper, tin, or an alloy. For example, the mating pin 105 can be made an aluminum alloy such as AA 6063 comprising at least aluminum, magnesium, and silicon. Alloys may be heat treated to a designation of T5, T6, T83, or similar temper, to produce a structurally robust mating pin 105 having high yield strength.

Figure 3:
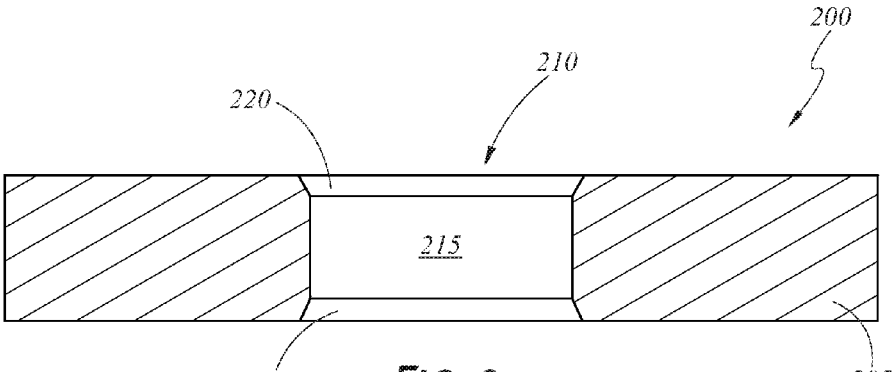
FIG. 3 is a cross-sectional view of a bus bar configured to connect with the bus bar mating connector of FIG. 1.

FIG. 3 depicts a cross-sectional view of a bus bar 200 configured to mechanically and electrically connect with the mating pin assembly 100 depicted in FIG. 1. The bus bar 200, or portions thereof, can be made of a conductive material 205, such as copper, brass, aluminum, or other metal, and includes a connection aperture 210 configured to receive a mating pin assembly (not shown in FIG. 3), such as the mating pin assembly 100 depicted in FIG. 1. The connection aperture 210 includes an aperture shaft 215 extending vertically through the bus bar 200. The aperture shaft 215 may be sized and shaped to receive a mating pin assembly 100. A distal chamfer 220 and a proximal chamfer 225 may be provided to increase the width of the connection aperture 210 near the distal and proximal faces of the bus bar 200. As will be described in greater detail below, the distal chamfer 220 and proximal chamfer 225 can facilitate and secure the connection between the bus bar 200 and a mating pin assembly.

Figure 4A:
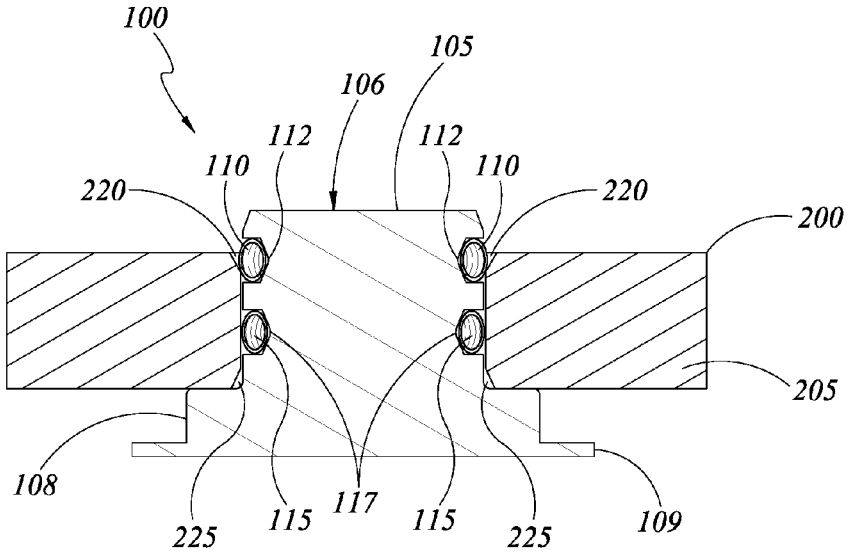
FIG. 4A is the same as FIG. 3 with the bus bar mating connector of FIG. 1 inserted into the bus bar of FIG. 3.
Figure 4B:
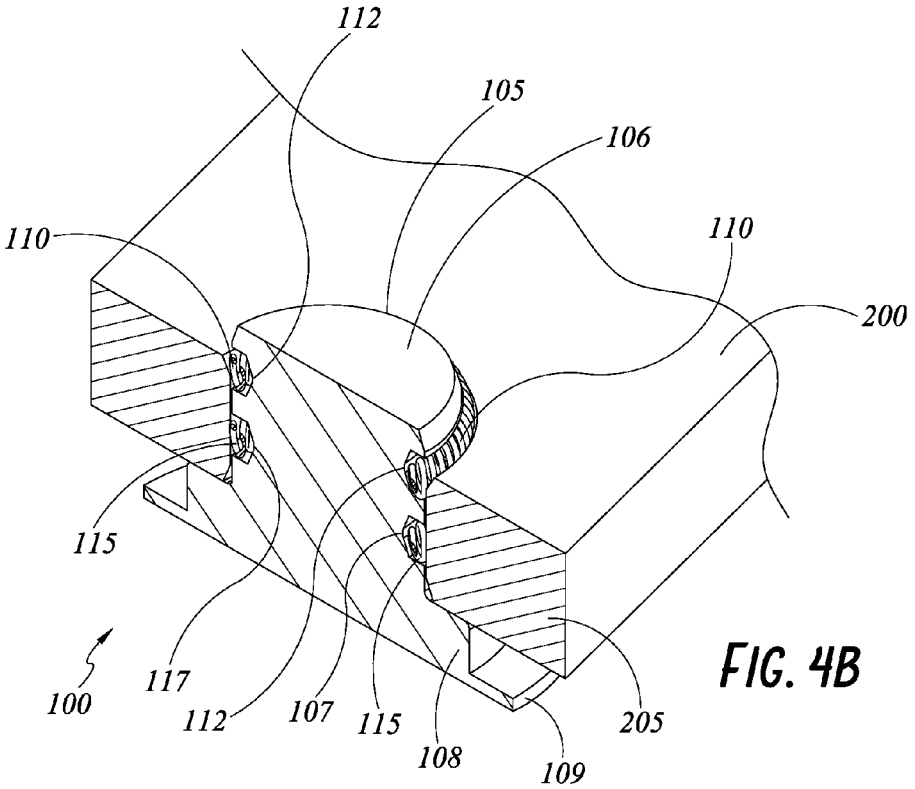
FIG. 4B is a perspective cross-sectional view of the bus bar and bus bar mating connector of FIG. 4A.

FIGS. 4A and 4B depict a portion of a bus bar 200 secured to a mating pin assembly 100 in accordance with an exemplary embodiment. FIG. 4A depicts a cross-sectional view taken about a line normal to a vertical axis and passing diametrically through the mating pin 105. FIG. 4B depicts a perspective cross-sectional view of the bus bar 200 and mating pin assembly 100 of FIG. 4A. As described with reference to FIG. 3, the bus bar 200 includes a solid material 205 and a connection aperture (occupied by mating pin assembly 100) with a distal chamfer 220 and a proximal chamfer 225. As described with reference to FIGS. 1-2B, the mating pin assembly 100 includes a mating pin 105, a distal spring 110, and a proximal spring 115. The mating pin 105 includes a distal surface 106, a distal groove 112 configured to receive and partially enclose the distal spring 110, a proximal groove 117 configured to receive and partially enclose the proximal spring 115, a support flange 108, and an attachment plate 109.

The distal chamfer 220 and proximal chamfer 225 of the bus bar 200 can be angled at any suitable angle relative to the interior surface of the aperture shaft 215. In various embodiments, the distal chamfer 220 and the proximal chamfer 225 can be the same angle or different angles. For example, a bus bar in certain embodiments may include a distal chamfer 220 angled at 30° relative to the aperture shaft 215, and a proximal chamfer 226 at a smaller angle, such as 25° or 15° relative to the aperture shaft 215. In some aspects, a proximal chamfer 225 at a relatively small angle may facilitate the compression of garter springs like the springs 110, 115 described with reference to FIG. 1 as the bus bar is placed onto a mating pin assembly. Conversely, a distal chamfer 220 at a relatively large angle may be advantageous by increasing the vertical component of the force of the distal spring 115 against the bus bar 200 to better secure the bus bar 200 in place.

With reference to the assembled bus bar 200 and mating pin assembly 100 connection depicted in FIGS. 4A and 4B, various advantages of the systems described herein will now be described in greater detail. In some aspects, the proximal chamfer 225 may facilitate fitting of the bus bar 200 onto the mating pin assembly 100 by increasing the positional tolerance of the alignment of the mating pin 105 with the connection aperture 210 of the bus bar. Thus, the proximal chamfer 225 can allow the bus bar 200 to be coupled to the mating pin assembly 100 by hand, rather than by machine, with relatively low skill required. Assembly by interference fit may also be performed more quickly than by other methods.

In other aspects, the distal chamfer 220 of the bus bar 200 may assist in confirming and maintaining the interference fit between the bus bar 200 and the mating pin assembly 100. As the bus bar 200 is placed onto the mating pin assembly 100, the interior surface of the aperture shaft 215 compresses the distal spring 110 and the proximal spring 115 to a cross-section width approximately equal to the depth of the distal and proximal grooves 112, 117. As the proximal surface of the bus bar 200 approaches the distal surface of the support flange 108, the larger interior diameter of the distal chamfer 220 of the bus bar 200 can permit the distal spring 110 to at least partially relax. The force exerted by the distal spring 110 against the angled surface of the distal chamfer 220 accordingly has a nonzero component in the proximal direction, increasing the strength of the interference fit to secure the bus bar 200 in place. The expansion of the distal spring 110 due to the distal chamfer 220 can further produce a click and/or vibration which can provide audible and/or tactile feedback to a person assembling the bus bar 200 to the mating pin assembly 100.

In some aspects, the interference fit provided by the systems described herein, without the need of further structures (e.g., bolts) to secure the bus bar 200 to the mating pin assembly allows for a low-profile bus bar mating assembly. For example, after the mating pin assembly 100 is coupled to the bus bar 200, the distal surface 106 of the mating pin 105 may extend beyond the distal surface of the bus bar 200 by as little as 5 mm, 3 mm, 2 mm, or less. Thus, the systems described herein may allow for more compact assembly of a bus bar and surrounding components in an electrical system. Attaching a bus bar to a mating pin without further securing structures can also decrease the probability of damage due to improper assembly (e.g., by overtightening a bolt securing a bus bar).

The foregoing description and claims may refer to elements or features as being "connected" or "coupled" together. As used herein, unless expressly stated otherwise, "connected" means that one element/feature is directly or indirectly connected to another element/feature, and not necessarily mechanically. Likewise, unless expressly stated otherwise, "coupled" means that one element/feature is directly or indirectly coupled to another element/feature, and not necessarily mechanically. Thus, although the various schematics shown in the Figures depict example arrangements of elements and components, additional intervening elements, devices, features, or components may be present in an actual embodiment (assuming that the functionality of the depicted circuits is not adversely affected).

The methods disclosed herein comprise one or more steps or actions for achieving the described method. The method steps and/or actions may be interchanged with one another without departing from the scope of the claims. In other words, unless a specific order of steps or actions is specified, the order and/or use of specific steps and/or actions may be modified without departing from the scope of the claims.

It is to be understood that the implementations are not limited to the precise configuration and components illustrated above. Various modifications, changes, and variations may be made in the arrangement, operation, and details of the methods and apparatus described above without departing from the scope of the implementations.

Although this invention has been described in terms of certain embodiments, other embodiments that are apparent to those of ordinary skill in the art, including embodiments that do not provide all of the features and advantages set forth herein, are also within the scope of this invention. Moreover, the various embodiments described above can be combined to provide further embodiments. In addition, certain features shown in the context of one embodiment can be incorporated into other embodiments as well.

What is claimed is:

1. A current carrying connection assembly between a first and second current flow path comprising:

a pin having at least one circumferential groove disposed therein, the groove forming at least a portion of a first electrical path through the pin;

at least one electrically conductive spring disposed within the circumferential groove;

a coupling having at least a portion of a second electrical path through the coupling, wherein the coupling comprises a distal chamfer and a proximal chamfer, and wherein the distal chamfer and the proximal chamfer are at different angles relative to one another; and a receiving space within the coupling, the receiving space sized and shaped to receive at least a portion of the pin, wherein the spring compresses upon insertion of the pin into the receiving space and forms an electrical connection between the first and second flow path and a mechanical connection between the pin and the coupling.

2. The assembly of claim 1, wherein the pin comprises a terminal post of a battery.

3. The assembly of claim 1, wherein the pin further comprises a second circumferential groove disposed therein and a second spring disposed within the second circumferential groove.

4. The assembly of claim 3, wherein the pin further comprises a third circumferential groove disposed therein and a third spring disposed within the third circumferential groove.

5. The assembly of claim 1, wherein the coupling comprises at least a portion of a bus bar.

6. An assembly for electrically connecting a bus bar to one or more electrical components, the assembly comprising:

a pin having a proximal end and a distal end;

a proximal groove disposed between and spaced vertically from the proximal end and the distal end, the proximal groove comprising a section of the pin having a smaller cross-sectional area than the adjacent sections of the pin proximal and distal to the proximal groove;

a distal groove disposed between and spaced vertically from the proximal groove and the distal end, the distal groove comprising a section of the pin having a smaller cross-sectional area than the adjacent sections of the pin proximal and distal to the distal groove;

a proximal garter spring disposed around the pin at least partially within the proximal groove; and a distal garter spring disposed around the pin at least partially within the distal groove;

wherein the proximal garter spring and distal garter spring are configured to compress in order to mechanically and electrically couple the pin to a bus bar when the pin is inserted into an opening in the bus bar, wherein the bus bar comprises a distal chamfer and a proximal chamfer, and wherein the distal chamfer and the proximal chamfer are at different angles relative to one another.

7. The assembly of claim 6, wherein the pin further comprises a support flange disposed between the proximal end and the proximal groove, the support flange spaced vertically from the proximal groove and comprising a section of the mating pin having a larger cross-sectional area than the adjacent section of the mating pin distal to the support flange.

8. The assembly of claim 7, wherein the support flange comprises a distal surface configured to abut a proximal surface of the bus bar coupled to the pin.

9. The assembly of claim 6, wherein the pin comprises a metal alloy.

10. The assembly of claim 9, wherein the metal alloy comprises aluminum.

11. The assembly of claim 6, wherein the proximal garter spring and the distal garter spring comprise a metal alloy.

12. The assembly of claim 11, wherein the metal alloy comprises copper.

13. The assembly of claim 6, wherein the proximal garter spring and the distal garter spring comprise slanted coil springs.

14. An electrical connection device comprising:

a mating assembly comprising:

an electrically conductive extension extending along a vertical axis, the extension having a distal end and a proximal end, the proximal end secured to a surface normal to the vertical axis;

a proximal garter spring disposed radially about the extension; and a distal garter spring disposed radially about the vertical axis at a location between and spaced vertically from the proximal garter spring and the distal end of the extension;

an electrically conductive bus bar comprising an aperture extending therethrough, the aperture configured to receive the extension, the aperture having a diameter smaller than an outer diameter of the proximal garter spring and an outside diameter of the distal garter spring, wherein the bus bar comprises a distal chamfer and a proximal chamfer, and wherein the distal chamfer and the proximal chamfer are at different angles relative to one another; and wherein the proximal garter spring and the distal garter spring are at least partially compressed by an interior surface of the aperture, and wherein the distal spring is configured to exert against the bus bar a force having a vertical component in the proximal direction.

15. The device of claim 14, wherein the aperture comprises a proximal end on a proximal surface of the bus bar and a distal end on a distal surface of the bus bar.

16. The device of claim 15, wherein the distal end of the aperture is circular and comprises a chamfer configured to contact the distal garter spring.

17. The device of claim 16, wherein the distal garter spring is configured to prevent vertical movement of the bus bar with respect to the extension.

18. The device of claim 14, wherein the proximal garter spring and the distal garter spring are configured to electrically connect the extension and the bus bar.

19. The device of claim 14, wherein the surface normal to the vertical axis is a portion of a housing, the housing containing one or more electrochemical cells connected electrically to the extension.

20. The device of claim 19, wherein the bus bar is electrically connected to one or more electrically powered systems configured to draw electric current from the one or more electrochemical cells through the electrical connection.

* * * * *